United States Patent [19]

Watanabe et al.

[11] Patent Number: 4,739,367

[45] Date of Patent: Apr. 19, 1988

[54] IMAGE FORMING APPARATUS HAVING A CONTROL MEANS FOR EFFECTING CONTROL OF A PRELIMINARY PROCESSING OF IMAGE FORMATION

[75] Inventors: Katsuzi Watanabe, Higashiyamato; Shizuo Tsuchiya, Tachikawa; Koji Maruyama, Akikawa, all of Japan

[73] Assignees: Casio Computer Co., Ltd.; Casio Electronics Manufacturing Co. Ltd., both of Tokyo, Japan

[21] Appl. No.: 923,281

[22] Filed: Oct. 27, 1986

[30] Foreign Application Priority Data

Nov. 7, 1985 [JP] Japan ..... 60-249644
Nov. 7, 1985 [JP] Japan ..... 60-249645

[51] Int. Cl.[4] ..... G03G 15/00

[52] U.S. Cl. ..... 355/14 R; 355/3 DR; 355/3 DD; 355/14 D

[58] Field of Search ..... 355/14 R, 14 D, 14 CH, 355/14 E, 3 DR, 3 CH, 3 DD

[56] References Cited

U.S. PATENT DOCUMENTS

| | | | |
|---|---|---|---|
| 4,036,556 | 7/1977 | Knight et al. | 355/14 R |
| 4,392,741 | 7/1983 | Inuzuka et al. | 355/14 R |
| 4,474,455 | 10/1984 | Hirakura et al. | 355/14 R |
| 4,500,195 | 2/1985 | Hosono | 355/3 R |
| 4,538,900 | 9/1985 | Lutus et al. | 355/3 CH X |
| 4,540,270 | 9/1985 | Imanaka et al. | 355/14 R X |

*Primary Examiner*—Arthur T. Grimley
*Assistant Examiner*—J. Pendegrass
*Attorney, Agent, or Firm*—Nixon & Vanderhye

[57] ABSTRACT

An apparatus for forming images is disclosed, in which a replaceable unit at least including a developing section is replaceably mounted in said apparatus body. Preliminary processing, such as developer agitation in said replaceable unit, is performed when a power source is connected and when the replaceable unit is mounted prior to an image formation operation. A timer started at the time of the connection of a power source is provided. A controller is provided to detect the output of the timer at the time of connection of the power source or at the time of the start of such an image formation operation for varying said preliminary processing according to the result of detection.

16 Claims, 5 Drawing Sheets

IMAGE FORMING APPARATUS HAVING A CONTROL MEANS FOR EFFECTING CONTROL OF A PRELIMINARY PROCESSING OF IMAGE FORMATION

BACKGROUND OF THE INVENTION

The invention relates to an image-forming apparatus, which is used with a plurality of different units that can be replaced with one another according to the desired toner color for printing and, more particularly, to an image-forming apparatus, in which the time of a preliminary processing of developer agitation can be varied according to the status of the apparatus.

In the prior art apparatus of this type, a plurality of units, each consisting of a photosensitive drum, a developing station and a cleaning station are provided separately for different toner colors, so that printing in various colors can be made by mounting a unit containing toner of a desired color in the apparatus body. At the time of the replacement, the replacement of consumables can be done simultaneously with the replenishment of developer or discharging of used toner.

In the unit, the developer which is contained in the developing section is prone to attenuation of its charged potential or comes to assume a semi-solidified state when the unit is left unused for long time. Further, in the case of a two-component developer, localized increase of toner concentration is liable.

Accordingly, a preliminary processing of developer agitation is executed before printing whenever the unit is replaced by opening the front door of the image forming apparatus body or the power switch is closed.

U.S. Pat. No. 4,500,195 discloses techniques concerning a replaceable unit constituting part of image formation means and also suitable alteration of the rotation of a photosensitive drum, the period of the rotation or exposure or charging condition at this time, as well as the agitation of the developer as the content of the preliminary processing noted above.

Further, U.S. Pat. No. 4,392,741 discloses a further techinque, in which time elapsed since the stopping of the rotary drum is measured, and the content of the preliminary processing is altered when and only when the measured time exceeds a predetermined period, e.g., 5 hours.

However, in the case of the former prior art example the preliminary processing noted above occurs when the power switch is re-closed after only a short period of time elapses since its opening without replacement of any unit during such time or when the door of the apparatus is opened to remove jammed sheets and is then closed again. In these situations, the preliminary processing only constitutes a waste of time. The agitation of developer as the preliminary processing is usually performed for about 60 seconds. The user, therefore, must wait for this time (e.g. about 60 seconds) until the agitation stops.

In the case of the latter prior art example, the preliminary processing is performed sufficiently only after the of 5 hours have elapsd. Therefore, in case when a replacement of a component requiring the preliminary processing is effected within 5 hours, sufficient preliminary processing is not performed in spite of the fact that the newly mounted part requires sufficient preliminary processing.

SUMMARY OF THE INVENTION

An object of the invention is to provide an image forming apparatus, which can obviate the above drawbacks, can effect a check as to whether replacement of unit has been done and causes necessary preliminary processing when the replacement of unit is detected or when a long time has passed without operation of the apparatus, while agitation of developer for a very short period of time is effected or the agitation processing is omitted in case when the power switch has been held "off" only for a short period of time or when the front door of the apparatus is opened.

To attain the above object of the invention, there is provided an apparatus for forming image, which comprises an apparatus body, photosensitive medium means, charging means provided in the neighborhood of the photosensitive medium means for charging the photosensitive medium means to a predetermined potential, exposure means for exposing the charged photosensitive medium means to a light image to form an electrostatic latent image on the photosensitive medium means, developing means for developing the electrostatic latent image formed on the photosensitive medium means to a toner image, transfer means for transferring the toner image to the transfer medium, a replaceable unit accommodating at least one of the photosensitive medium means and the developing means and replaceably mounted in the apparatus body, detecting means for detecting that no image formation operation occurs for a predetermined period of time and checking whether the replaceable unit has been replaced in the predetermined period of time, and control means for effecting control of the execution of a preliminary processing with respect to at least one of the photosensitive medium means and the developing means mounted in the apparatus body when it is detected by the detecting means when the period free from image formation operation is within a predetermined period and that the replaceable unit is not replaced.

With the above construction of the apparatus for forming image according to the invention, the regular preliminary processing such as agitation of developer is performed only when it is necessary, i.e., when a preset period of time has passed since the opening of the power switch or when the mounted unit has been removed from the apparatus for replacement. Thus, the waiting time that otherwise results when unnecessary preliminary processing is performed, can be eliminated. Further, when the power switch is held "off" for a short period of time or when the frot door of the apparatus is opened in such case as occurrence of jamming, agitation of the developer may be caused only for a very short period of time. The period of the preliminary processing thus can be controlled according to the status of the apparatus.

DETAILED DESCRIPTION OF THE PREFERRED EMBODIMENT

Now, one embodiment of the invention will be described with reference to the drawings.

Figure 1:
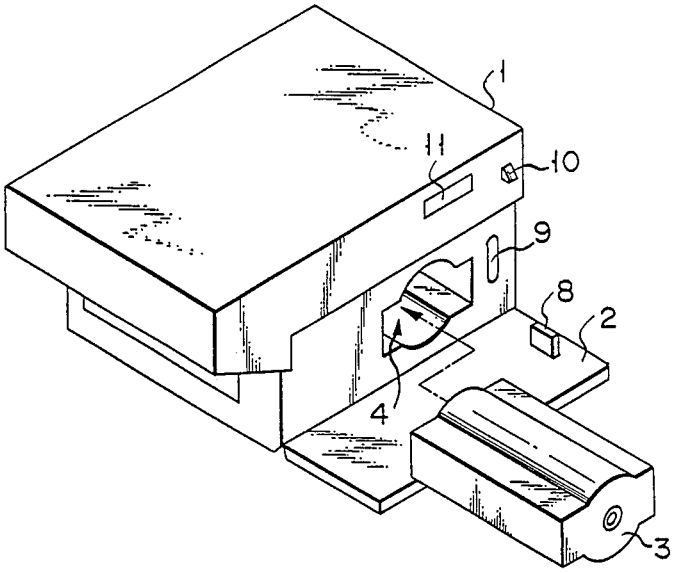
FIG. 1 is a perspective view showing one embodiment of the apparatus for forming image according to the invention.
Figure 2:
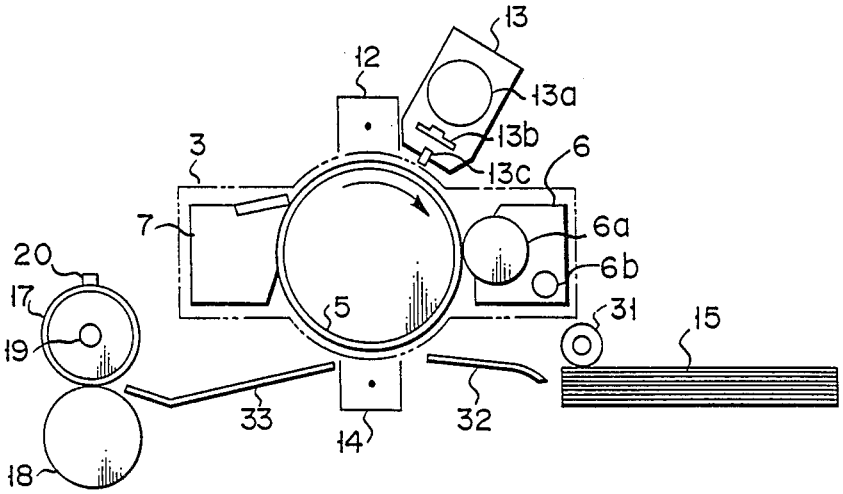
FIG. 2 is a schematic view showing the embodiment of the image forming apparatus with a replaceable unit mounted therein.

Referring to FIG. 1, there is shown an apparatus for forming image according to the invention. The apparatus comprises body 1 provided at the front with door 2 which can be opened and closed. Apparatus body 1 has inner space which is open as front central opening 4 when door 2 is opened. Image formation unit 3 (hereinafter referred to as unit) is removably mounted in the inner space. On the inner side of opening 4, there is provided a switch (not shown) which is turned on when unit 3 is mounted in the apparatus. Door 2 has projection 8 provided on the inner side. Apparatus body 1 is provided with slit-like recess 9 which corresponds in position to projection 8. A door switch (not shown) is provided in the depth of recess 9. When door 2 is closed, the door switch is depressed by projection 8 to be turned on. When door 2 is opened, the door switch is turned off. The door switch is connected in series with power switch 10 of apparatus body 1. When and only when power switch 10 is turned on and also the door switch is turned on with the closure of door 2, apparatus body 1 is furnished with power. Apparatus body 1 is provided with display section 1 using liquid crystal or the like. When unit 3 is mounted in apparatus body 1, photosensitive drum 5 is rotated in the direction of arrow as shown in FIG. 2 in an image forming operation. Photosensitive drum 5 is charged to a predetermined potential with corona discharge in charging station 12. In exposure station 13, the charged surface of photosensitive drum 5 is exposed to a light flux corresponding to an image to form an electrostatic latent image on photosensitive drum 5. Developing station 6 accommodates a developer. Developing roller 6*a* is rotated with developer carried on the periphery, whereby the electrostatic latent image formed on photosensitive drum 5 is developed to form a toner image while the accommodated developer is agitated. Agitating roller 6*b* is provided to ensure agitation of the developer, and it is rotated with the rotation of developing roller 6*a*.

Paper feeding operation is performed with the rotation of paper feed roller 31. Transfer sheet 15 having proceeded along guide 32 receives corona discharge in transfer station 14 at a position, at which the speed overlaps the toner image formed on photosensitive drum 5. As a result, transfer sheet 15 is brought into close contact with photosensitive drum 5, and a toner image is transferred onto transfer sheet 15. Transfer sheet 15 with the transferred toner image is separated from photosensitive drum 5 by separating means (not shown) to proceed along guide 33 into between fixing rollers 17 and 18 in forced contact with each other. The toner image on transfer sheet 15 is heated, pressed and fixed by fixing rollers 17 and 18. The residual toner remaining on photosensitive drum 5 without being transferred to transfer sheet 15 is removed by cleaner 7.

As unit 3 noted above, a plurality of units for different toner colors, e.g., red, blue, black, etc., are prepared separately, so that the unit 3 may be replaced for printing in desired colors. One of fixing rollers 17 and 18, i.e., roller 17, has internal heater 19, and thermistor 20 is provided in contact with the roller periphery. Thermistor 20 detects the roller surface temperature, and a temperature controller to be described later controls power supplied to heater 19 according to the detected temperature value, whereby the surface temperature of fixing roller 17 is controlled to a predetermined temperature.

Figure 3:
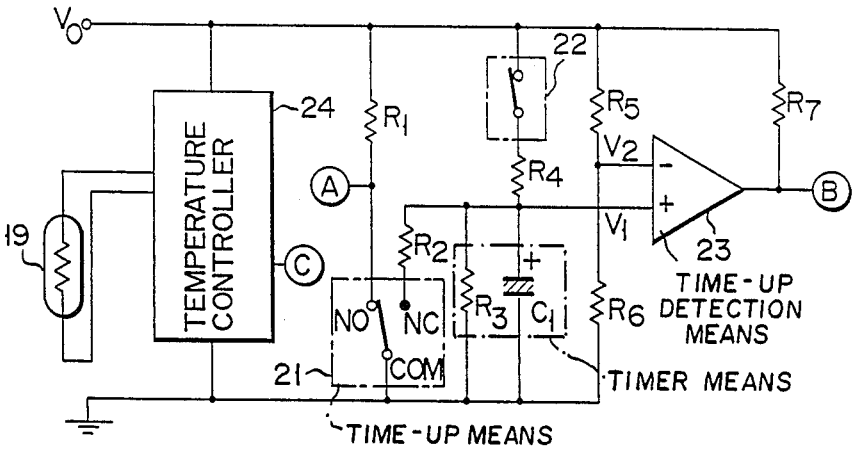
FIG. 3 is a circuit diagram of the embodiment of the invention.

FIG. 3 shows the circuit construction of the embodiment of the invention.

Referring to the Figure, reference numeral 21 designates a microswitch which is provided inside opening 4. When unit 3 is mounted in the apparatus, the movable contact of the switch is in contact with a normally open terminal (NO), as shown in FIG. 3. In this state, the voltage at point A is at a low level. When unit 3 is removed from the apparatus, the movable contact of microswitch 21 is brought into contact with normally closed terminal (NC). As a result, the voltage at point A is inverted to a high level microswitch 21 functions as a "time-up means". Reference numeral 22 designates a relay switch, which is turned on after the power switch is turned on and the door switch is turned on with the closure of the front door of the apparatus and is turned off when the power switch is turned off and also when the front door is opened. When relay switch 22 is turned on, capacitor C1 is charged through resistor R1, and output V1 of a time constant circuit consisting of resistor R4 and capacitor C1 is fed to a non-inverted input terminal (plus terminal) of comparator 23. To an inverted input terminal (minus terminal) of comparator 23 is fed voltage V2 as reference voltage from a voltage divider consisting of resistors R5 and R6 dividing supply voltage V0. Thus, when the front door of the apparatus is closed with the power switch "on", capacitor C1 is charged. Capacitor C1 is charged at this time momentarily because the resistance of resistor R4 is low. When capacitor C1 is charged, output voltage V1 of the time constant circuit is higher than reference voltage V2 (i.e., $V1 > V2$), so that the output of comparator 23 is at high level.

Figure 4:
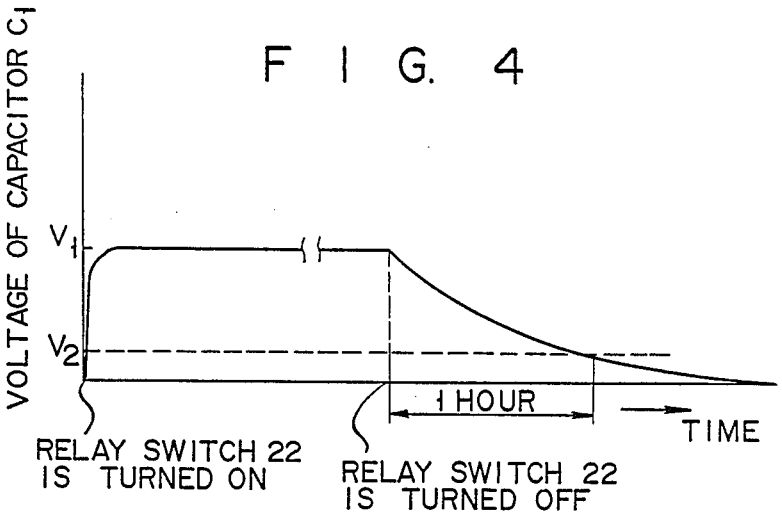
FIG. 4 is a time chart showing the operation of the circuit shown in FIG. 3.

When power switch 10 is turned off or front door 2 is opened, relay switch 22 is turned off. As a result, capacitor C1 is discharged through resistor R3 as shown in FIG. 4. In this case, the discharge to the side of the comparator 23 can be ignored because of high input impedance of comparator 23. The discharge time of capacitor C1 is set to be long by selecting a high resistance resistor as resistor R3. In this embodiment, the period taken for the discharge of capacitor C1 from voltage V1 to V2 is set to be approximately one hour. Thus, one hour after relay switch 22 is turned off, a condition $V1 < V2$ is met, so that the output of comparator 23 is inverted from high level to low level capacitor C1 and resistor R3 function as a "timer means" while comparator 23 functions as a "time-up detection means".

When unit 3 is removed from apparatus body 1, microswitch 21 is turned on as noted above with its movable contact brought into contact with normally closed terminal (NC), thus grounding resistor R2. The resistance as viewed from capacitor C1 thus is the parallel resistance of resistors R2 and R3. Resistance R2 has low resistance. Thus, when capacitor C1 is discharged momentarily and unit 3 is removed, the output of comparator 23 is immediately inverted to low level. Reference numeral 24 in the Figure designates temperature controller, which controls the surface temperature of fixing roller 17 to be constant through control of the current through heater 19. Output C of the temperature controller 24 is at low level before the reaching of a predetermined temperature at the time of the closure of the power switch. When the predetermined temperature is reached, the output C is at high level, and it is provided as a print ready signal to a main controller.

Figure 5:
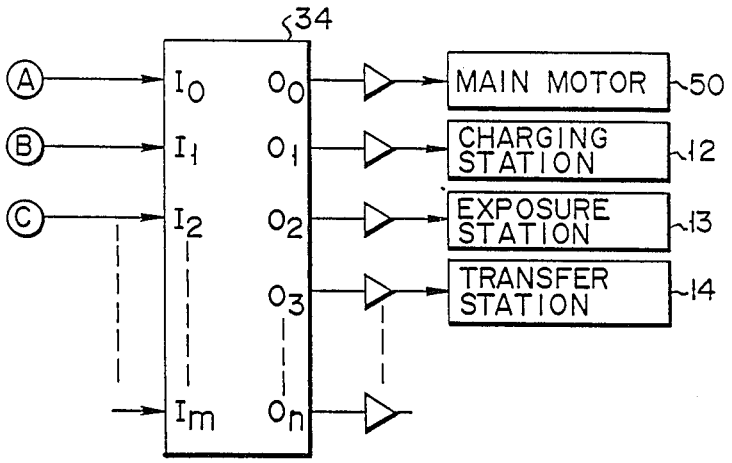
FIG. 5 is a view showing a CPU controlled according to each output from the circuit shown in FIG. 3 and various devices controlled according to the output of the CPU.

The main controller is as shown in FIG. 5. Signals I0, I1, I2 ... Im corresponding to the results of detection by various sensors for detecting the status of inner components (not shown) of the apparatus are fed as input signals, which are represented by output signals, A, B, C, ..., to CPU 34. According to these input signals I0 to Im, CPU 34 feeds corresponding operation signals to main motor 50, charging station 72, exposure station 13, transfer station 14 and other operating means.

Figure 6:
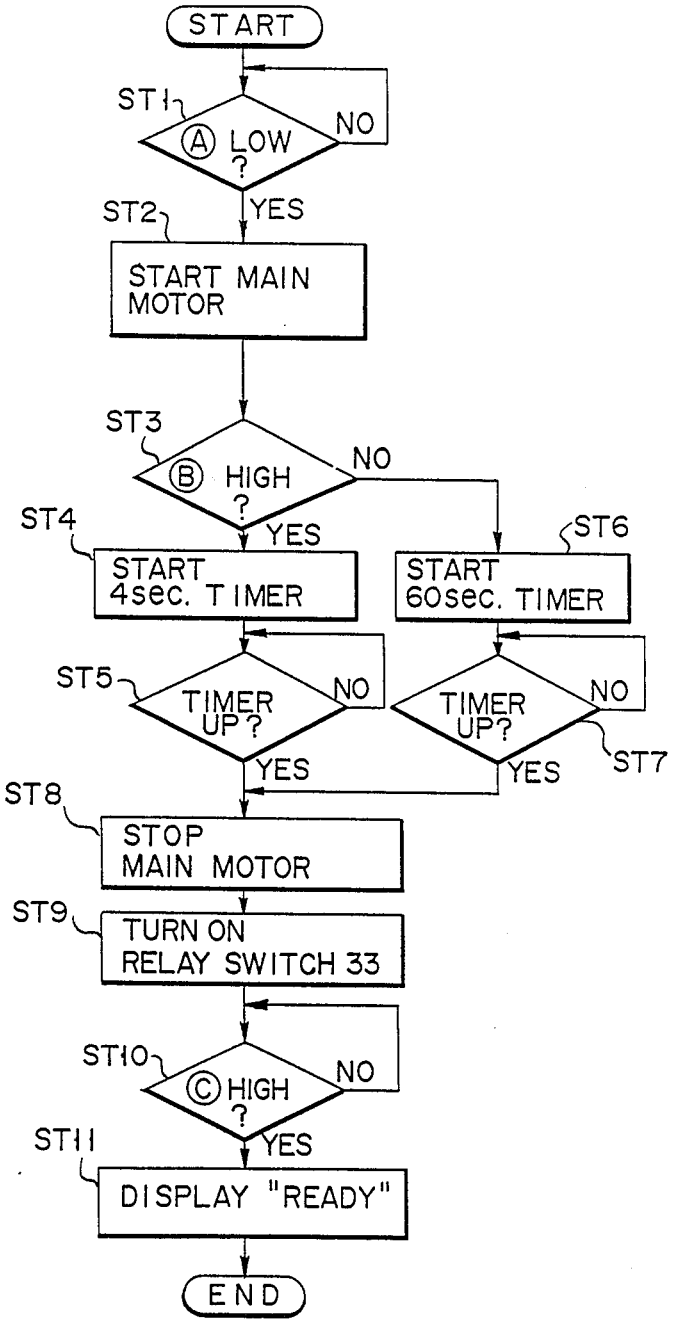
FIG. 6 is a flow chart for explaining the operation of the circuit shown in FIG. 3.

FIG. 6 is a flow chart illustrating the operation of the embodiment. Now, the operation will be described with reference to the Figure. If it is detected in step 1 (hereinafter referred to as ST) that the voltage at point A in FIG. 3 is at low level, i.e., if it is detected that unit 3 is mounted in apparatus body 1 and resistor R1 is grounded through microswitch 21, main motor 50 is started in ST 2. If the voltage at point A is at high level, the main motor 50 is not rendered operative. Then, if it is detected in ST 3 that output B of comparator 23 is at high level, a 4-second timer (not shown) is started in ST 4. The 4-second timer is a timer for determind the period of agitation of developer in the unit. The high level signal from comparator 23 is fed to main controller (CPU) 34 as shown in FIG. 5. As a result, developing roller 6*a* and agitatating roller 6*b* provided in the developing section 6 are driven by main motor 50 to agitate developer for 4 seconds until the time-up of timer is detected in ST 5. The output of comparator 23 is at the high level while voltage V1 across capacitor C1 is higher than reference voltage V2, so that the output of comparator 23 is at the high level for one hour from the instant when the power switch is turned off. Thus, when the power switch is turned on again within one hour from the instant after the power switch is turned off, agitation of developer is caused for a short period of time of 4 seconds. This is done so for the reason that the attenuation of charged occur unless one hour has been passed from the instant of closure of the power switch. Although in this embodiment the agitation is caused for 4 seconds, this is by no means limitative, that is, the agitation may be effected for a longer or shorter period or may not be effected at all.

If it is detected in ST 3 that output B of comparator 23 is at the low level, this low level signal constitutes a developer agitation command signal, and in ST 6 a 60-second timer is started to render main motor 50 operative. As a result, the developer in the unit is agitated for 60 seconds. Output B of comparator 23 goes to low level when voltage V1 across capacitor C1 becomes lower than V2. This occurs either when one hour has passed from the instant of opening of the power switch or when the unit is taken out of the apparatus within one hour from the instant of opening of the power switch. Thus, when either one of these two conditions is met, the developer is sufficiently agitated to prevent attenuation of the charged potential and permit satisfactory development. When the time-up is detected in ST 7, 60 seconds afterwards, the agitation of developer is stopped.

When the agitation of developer is ended in ST 5 and ST 7, the main motor 50 is stopped in ST 8. Then, in ST 9 relay switch 22 is turned on to cause charging of capacitor C1 again to be ready for the next opening of the power switch. Subsequently, when and only when it is detected in ST 10 that output C of temperature controller 24 is at high level, i.e., when a predetermined temperature is reached by the fixing roller surface temperature, a ready-to-print sets in. A this time, a ready-to-print signal is produced and displayed on a display section in ST 11.

It is possible to set the discharge time of capacitor C1 to be sufficiently long so that relay switch 22 is turned on during the image formation operation period. In this case, it is possible to judge output B of comparator 23 prior to the image formation operation and vary the period of developer agitation according to the result of the judgement prior to the actual image formation operation. In this case, it is possible to cause agitation of the developer when no image formation operation has been caused for long time after the closure of the power switch. Further, the relay switch may be turned off at the instant of end of the image formation operation.

Figure 7:
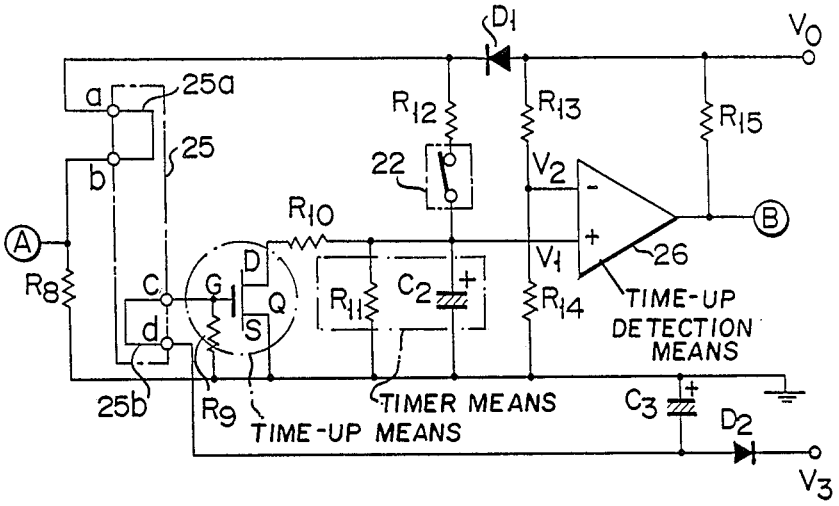
FIG. 7 is a circuit diagram showing a different embodiment of the invention.

FIG. 7 shows a different embodiment of the invention. In the preceding embodiment shown in FIG. 3, with the removal of unit 3 from the apparatus body microswitch 21 is turned on to cause instantaneous discharge of capacitor C1. As a result, the output of comparator 23 is inverted to low level. In this embodiment, short-circuit bars 25*a* and 25*b* are used in lieu of microswitch 21. In FIG. 7, temperature controller is omitted. The constitution and operation of this embodiment will now be described.

Figure 8:
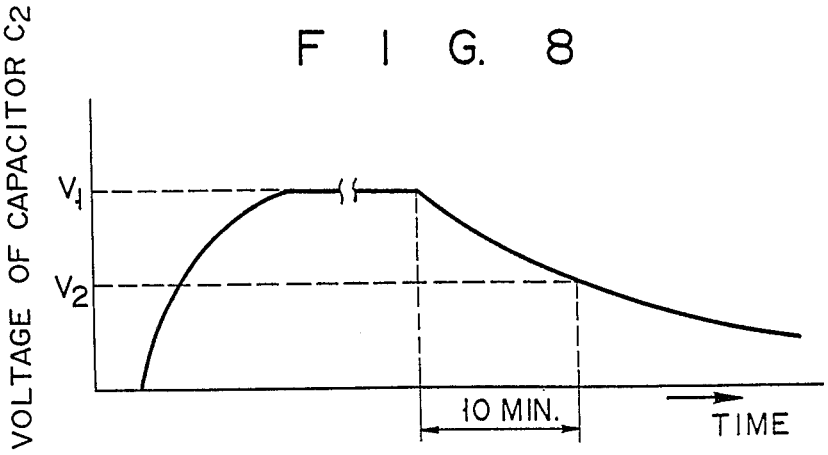
FIG. 8 is a time chart showing the operation of the circuit shown in FIG. 7.

In the Figure, reference numeral 25 designates a short-circuit bar section which is used in lieu of microswitch. The section consists of short-circuit bars 25*a* and 25*b*. The individual short-circuit bars are provided on in the unit. When the unit is mounted in the apparatus body, circuits between points a and b and between points c and d are short-circuited by short-circuit bars 25*a* and 25*b*. When the circuits between points a and b and between points c and d are short-circuited, a negative voltage is applied to the gate of a depletion type field-effect transistor Q (hereinafter referred to as FET-Q). FET-Q is thus turned off. When this occurs with the power switch "on" and the unit mounted, relay switch 22 is "on", capacitor C2 is charged, and voltage V1 of capacitor C2 is higher than the other reference voltage V2. Output B of comparator 26 thus is at high level. When the power switch is turned off in this state, relay switch 22 is turned off. Since FET-Q is "off" due to negative voltage across capacitor C3, capacitor C2 is discharged through resistor R11. Resistor R11, like the previous embodiment, is a high resistance resistor, and the time constant of the circuit consisting of resistor R11 and capacitor C2 is set such that the time until voltage V1 becomes lower than voltage V2 at the non-inverted input terminal of comparator 26 as shown in FIG. 8 is 10 minutes. When 10 minutes have passed from the instant of opening of the power switch, output B of comparator 26 goes to low level.

The operation of the circuit of the embodiment of FIG. 7 can be explained using the flow chart of FIG. 6. As in the previous embodiment, when the developer is agitated for 60 seconds (ST 6) and the power switch is closed again in 10 minutes, output B of comparator 26 is at high level, so that the agitation of the developer for 4 seconds is caused (ST 4).

When the power switch is turned off and the unit is taken out, there occurs a state with short-circuit bars 25*a* and 25*b* taken out. Thus, the circuits between points a and b and between points c and d are open-circuited, so that FET-Q is turned on. As a result, capacitor C2 is discharged through resistors R11 and R10. At this time, capacitor C2 is discharged momentarily for resistor R10 has a low resistance. Thus, when the unit is taken out, output B of comparator 26 immediately goes to low level, and when a new unit is mounted and the power switch is closed, agitation of the developer is caused for 60 minutes. In this embodiment, agitation of the developer for 60 seconds is caused when 10 minutes has passed from the instant of the opening of the power switch. However, the agitation may be caused after the lapse of one hour or any desired time as in the previous embodiment.

As has been shown, when the power switch is turned on again after the lapse of a predetermined period of time from its closure, the developer is agitated sufficiently. It is thus possible to solve the problems of attenuation of charged potential of the developer and obtain satisfactory development. When the unit is removed, the capacitor is forcibly discharged momentarily. This state is the same as is brought about after the lapse of the predetermined period of time as noted above. Thus, sufficient agitation of the developer can be effected to obtain satisfactory development. On the other hand, when the power switch is held "off" for a short period of time or when the front door of the apparatus is held open for a short period of time for the removal of jammed sheets or like purpose, agitation of the developer is caused only for a short period of time. It is thus possible to eliminate the waiting time during the unnecessary developer agitation operation as in the prior art.

In the above embodiments, the agitation of the developer is effected with the drive force of the main motor, but this is by no means limitative, and it is possible to provide an exclusive motor to this end. Further, in the above embodiments the period of agitation of the developer is varied. However, in case where the photosensitive medium is subjected a preliminary processing such as light illumination or charging at the time of the closure of the power switch, it is possible to vary the period of the prelinary processing, light exposure dose, charging voltage, etc.

Now, a further embodiment of the invention will be described with reference to FIG. 9.

In the Figure, reference numeral 3 designates unit which is removably mounted in apparatus body 1. Unit 3 includes short-circuit bar 31 and a time constant circuit consisting of resistor R2 and capacitor C1 parallel to each other. When unit 3 is mounted in the apparatus, it is connected to apparatus body 1 at points a, b and c. As a result, resistor R1 and short-circuit bar 31 are connected in series, and resistor R1 is grounded. Further, resistor R3 and time constant circuit are connected in series. Thus, when unit 3 is mounted, the voltage at point A in the Figure goes to low level. When unit 3 is removed, it goes to high level. Reference numeral 33 designates relay switch, which is turned on when the front door of the apparatus is closed with the power switch "on" and is turned off when the power switch is turned off and also when the front door is opened. When relay switch 33 is turned on, capacitor C1 is charged through resistor R3 up to a voltage V1, i.e., $V1=[V0 \cdot R2/(R2+R3)]$, which is, the output of voltage divider consisting of resistors R2 and R3 for dividing supply voltage V0. At this time, capacitor C1 is charged momentarily for resistor R3 has low resistance. Voltage V1 is fed to a non-inverted input terminal (plus (+) terminal) of comparator 23. To an inverted input terminal (negative (−) terminal) of comparator 23 is fed as reference voltage a voltage of V2, i.e., $V2=[V0 \cdot R5/(R4+R5)]$, which is the output of voltage divider consisting of resistors R4 and R5 dividing supply voltage V0. The resistances of the individual resistors are set such that voltage V1 across capacitor C1 is high level when unit 3 is mounted. Thus, when unit 3 is mounted, a condition $V1>V2$ is met, so that output B of comparator 23 goes to high level.

When the power switch is turned on or when the front door is opened, relay switch 33 is opened to cause discharge of capacitor C1 through resistor R2. The discharge of capacitor C1 is also caused when unit 3 is removed. Resistor R2 is selected to be one having a high resistance to provide a long discharge time of a capacitor C1. In this embodiment, the time of discharge of capacitor C1 from voltage V1 to voltage V2 is set to one hour. Thus a condition $V1<V2$ is met after the instant of turning-on of relay switch 33, output B of the comparator is inverted from high level to low level. In the Figure, reference numeral 24 designates a temperature controller which controls the surface temperature of fixing roller 17 to be constant through control of current through heater 19. Output C of the temperature controller is at low level before the reaching of a predetermined temperature after closuer of the power switch and goes to high level at the time of the reaching of a predetermined temperature. This output is fed as a print ready signal to the main controller. The main controller is as shown in FIG. 5.

Figure 9:
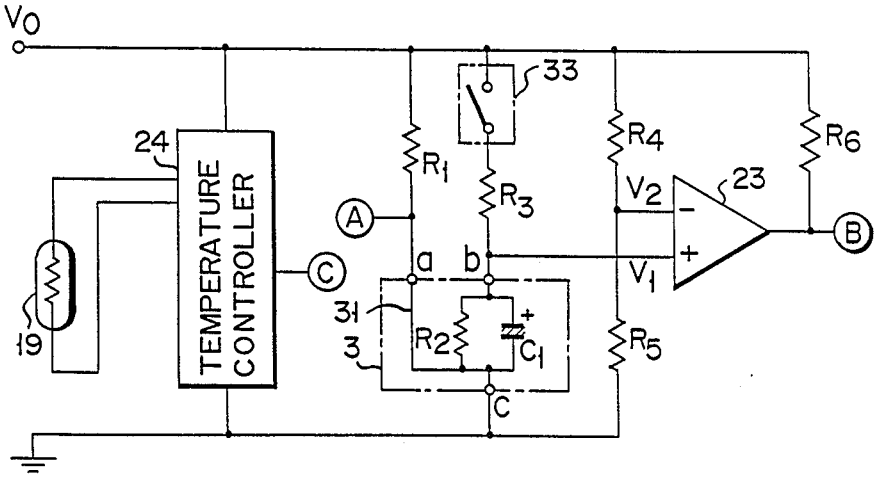
FIG. 9 is a circuit diagram showing a further embodiment of the invention.

The operation of the circuit of the embodiment of FIG. 9 can be explained using the flow chart of FIG. 6.

If it is detected in ST 1 that the voltage at point A is at low level, i.e., if unit 3 is mounted in apparatus body 1 so that resistor R1 is grounded, main motor 50 is started in ST 2. If output A is at low level, the main motor 50 is not rendered operative. If it is detected in ST 3 that output B of comparator 23 is at high level, a 4-second timer (not shown) is started in ST 4. The 4-second timer is used to set a time of aditation of the developer in unit 3. Thus, developing roller 6*a* and agitating roller 6*b* provided in the developing section are driven to agitate the developer for 4 seconds until the time-up of timer in ST 5. The output of comparator 23 goes to high level when voltage V1 across capacitor C1 is higher than reference voltage V2. The output of comparator 23 thus is held at high level in one hour from the instant of opening of the power switch and also from the instant of opening of the front door. Thus, when the power switch is turned on again within one hour from its closure or when the front door is closed within one hour from the instant of its opening, agitation of the developer is caused for a short period of 4 seconds as restricted by a 4-second timer. This is done so for the reason that the agitation period of 4 seconds is sufficient in that attenuation of the charging potential of the developer is not caused within one hour from the instant of closure of the power switch. Further, when the unit is taken out by opening the front door and is mounted again within one hour, output B of the comparator 23 is at high level for voltage V1 across capacitor C1 is higher than V2. Thus, the agitation of the developer may be caused only for 4 seconds as in the above case. While in the above case the developer has been agitated for 4 seconds, this is by no means limitative, and the developer agitation may be caused for a longer or shorter period or may not be caused.

If it is detected in ST 3 that output B of the comparator 3 is at low level, this low level signal constitutes a developer agitation signal, and in ST 6 a 60-second timer (not shown) is started to render an agitating device (not shown) operative. As a result, the developer in unit 3 is agitated for one minute. More specifically, output B of comparator 23 goes to low level when voltage V1 across capacitor C1 becomes lower than V2, that is, when one hour has passed from the instant of opening of the power switch or from the instant of opening of the front door. In these two cases, the developer is sufficiently agitated to prevent attenuation of the charging potential for satisfactory development. Further, when taking out the unit by opening the front door and mounting a different unit for altering the toner color, the voltage across capacitor C1 is low because the unit has been left. Thus, output B of comparator 23 goes to low level. Like the above case again the developer is agitated for 60 seconds. When the time-up of the timer occurs after 60 seconds as shown in ST 7, the agitation of the developer is stopped.

When the agitation of the developer is ended in steps ST 5 and ST 7, the main motor 50 is stopped in ST 8. Then in step ST 9, relay switch 33 is turned on to charge capacitor C1 again, to be ready for the next opening of the power switch. Subsequently, when it is detected in ST 10 that output C of temperature controller 24 is at high level, that is, when the surface temperature of the fixing roller is increased up to a predetermined temperature, a ready-to-print state sets in, thus providing a ready signal which is displayed on a display section.

It is possible to set a sufficiently long discharge time of capacitor C1 so that relay switch 33 is turned on during the image formation operation period. In this case, it is possible to judge output B of comparator 23 and vary the developer agitation period (4 sec or 6 sec) prior to the actual image formation operation. With this arrangement, it is possible to effect agitation of the developer in case when no image formation operation has been done for a long time after closure of the power switch.

As has been described in the foregoing, sufficient agitation of the developer is caused in case when the power switch is turned on again after the lapse of a predetermined period time from its opening. It is thus possible solve the problems of attenuation of the charged potential of the developer and obtain satisfactory development. Further, in case when the unit is taken out, it is possible to cause sufficient agitation of the developer for satisfactory development so long as a preset time has been passed. On the other hand, when the power switch is turned off for a short period of time or when the front door is held open for a short period of time for the removal of jammed sheets, for instance, the period of the developer agitation is reduced. It is thus possible to eliminate the waiting time during unnecessary agitation as in the prior art.

In this embodiment the developer is agitated by the drive force of the main motor 50. However, this is by no means limitative, and it is possible to provide an exclusive motor. Further, in the above embodiment the developer agitation time is varied. However, in case when the photosensitive medium is subjected to light illumination, charging or like preliminary processing when closing the power switch, it is possible to vary the processing period, light dose or charging voltage. Further, it is possible to cause no preliminary processing when the time until the power switch is turned on again or the front door is closed again.

What is claimed is:

1. An image forming apparatus having a control means for effecting control of a preliminary processing of image information, comprising:

an apparatus body;

photosensitive medium means;

charging means provided in the neighborhood of said photosensitive medium means, for charging said photosensitive medium means to a predetermined potential;

exposure means for exposing said charge photosensitive medium means to a light image to form an electrostatic latent image on said photosensitive medium means;

developing means for developing said electrostatic latent image formed on said photosensitive medium means to a toner image;

transfer means for transferring said toner image to a transfer medium;

a replaceable unit accommodating at least one of said photosensitive medium means and said developing means and replaceably mounted in said apparatus body;

detecting means for detecting a predetermined period of time in which no image formation operation occurs and for checking whether said replaceable unit has been replaced within said predetermined period of time;

said detecting means including (1) timer means provided in said apparatus body for measuring said predetermined period of time in which no image formation operation occurs, (2) time-up detection means provided in said apparatus body for detecting time-up of said timer means, and (3) time-up means provided in said apparatus body for initiating said time-up of said timer means in response to removal of said replaceable unit from said apparatus body; and wherein said apparatus further comprises, control means for effecting control of the execution of a preliminary processing with respect to at least one of said photosensitive medium means and said developing means mounted in said apparatus body when said detecting means detects that a time period in which no image formation operation occurs is within said predetermined period of time and that said replaceable unit is not replaced.

2. The apparatus according to claim 1, wherein said timer means begins to measure said predetermined period of time in which no image formation operation occurs from the instant when a power source is disconnected.

3. The apparatus according to claim 2, wherein said timer means includes a resistor and a capacitor to be discharged with a predetermined time constant from the instant of disconnection of a power source, and said time-up detection means is means for detecting the voltage across said capacitor, and said time-up means is means for causing a discharge of said capacitor with a time constant smaller than said predetermined time constant in response to removal of said replaceable unit from said apparatus body.

4. The apparatus according to claim 1, wherein said timer means measures time elapsed after the end of an image formation operation.

5. The apparatus according to claim 4, wherein said timer means includes a resistor and a capacitor to be discharged with a predetermined time constant from the end of an image formation operation, said time-up detection means includes means for detecting the voltage across said capacitor, and said time-up means is means for causing a discharge of said capacitor with a time constant smaller than a predetermined time constant according to an operation of removing said replaceable unit from said apparatus body.

6. The apparatus according to claim 1, wherein said replaceable unit accommodates said developing means, said developing means includes agitating means for agitating developer, and said control means controls the developer agitation operation of said agitating means as a preliminary processing when said control means is connected to a power source.

7. The apparatus according to claim 1, wherein said replaceable unit accommodates said photosensitive medium means, and said control means controls the charging operation of said charging means with respect to said photosensitive medium means as a preliminary processing when said control means is connected to a power source.

8. The apparatus according to claim 1, wherein said replaceable unit accommodates said photosensitive medium means, and said control means controls the exposure of said photosensitive medium means by said exposure means as a preliminary processing when said control means is connected to a power source.

9. The apparatus according to claim 1, wherein said replaceable unit accommodates said developing means, said developing means includes agitating means for agitating developer, and said control means controls the developer agitation operation of said agitating means as a preliminary processing prior to the start of an image formation operation.

10. The apparatus according to claim 1, wherein said replaceable unit accommodates said photosensitive medium means, and said control means controls charging operation of said photosensitive medium means by said charging means as a preliminary processing prior to the start of an image formation operation.

11. The apparatus according to claim 1, wherein said replaceable unit accommodates said photosensitive medium means, and said control means controls exposure of said photosensitive medium means by said exposure means as a preliminary processing prior to the start of an image formation operation.

12. An image forming apparatus having a control means for effecting control of a preliminary processing of image formation, comprising:

an apparatus body;

photosensitive medium means;

charging means provided in the neighborhood of said photosensitive medium means, for charging said photosensitive medium means to a predetermined potential;

exposure means for exposing said charged photosensitive medium means to a light image to form an electrostataic latent image on said photosensitive medium means;

developing means for developing said electrostatic latent image formed on said photosensitive medium means to a toner image;

transfer means for transferring said toner image to a transfer medium;

a replaceable unit accommodating at least one of said photosensitive medium means and said developing means and replaceably mounted in said apparatus body;

detecting means for detecting a predetermined period of time in which no image formation operation occurs and for checking whether said replaceable unit has been replaced within said predetermined period of time, said detecting means including timer means provided in said replaceable unit for measuring said predetermined period of time in which no image formation operation occurs, and time-up detection means provided in said apparatus body and connectable to said timer means when said replaceable unit is mounted in said apparatus body for detecting the time-up of said timer means; and control means for effecting control of the execution of a preliminary processing with respect to at least one of said photosensitive medium means and said developing means mounted in said apparatus body when said detecting means detects that a time period in which no image formation operation occurs is within said predetermined period of time and that said replaceable unit is not replaced.

13. The apparatus according to claim 12, wherein said timer means begins to measure said predetermined period of time in which no image formation operation occurs from the instant of disconnection of a power source.

14. The apparatus according to claim 13, wherein said timer means includes a resistor and a capacitor to be discharged with a predetermined time constant from an instant when a power source is disconnected, and said time-up detection means is means for detecting the voltage across said capacitor.

15. The apparatus according to claim 12, wherein said timer means measures time elapsed after the end of an image formation operation.

16. The apparatus according to claim 15, wherein said timer means includes a resistor and a capacitor to be discharged with a predetermined time constant from an instant of end of an image formation operation, and said time-up detection means is means for detecting the voltage across said capacitor.

* * * * *